US012798632B2

(12) United States Patent
Yang et al.

(10) Patent No.: US 12,798,632 B2
(45) Date of Patent: Nov. 17, 2026

(54) ANTI-SIDE-ROLLING DAMPING VEHICLE-END DEVICE, AND RAIL VEHICLE AND TRAIN

(71) Applicant: CRRC QINGDAO SIFANG CO., LTD., Qingdao (CN)

(72) Inventors: Dongxiao Yang, Qingdao (CN); Yonghua Feng, Qingdao (CN); Jun Feng, Qingdao (CN); Guoping Zhang, Qingdao (CN); Haixiao Liang, Qingdao (CN); Guiyu Li, Qingdao (CN); Qiang Wang, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 482 days.

(21) Appl. No.: 18/280,644

(22) PCT Filed: Jan. 5, 2022

(86) PCT No.: PCT/CN2022/070345
§ 371 (c)(1),
(2) Date: Sep. 6, 2023

(87) PCT Pub. No.: WO2022/199208
PCT Pub. Date: Sep. 29, 2022

(65) Prior Publication Data

US 2024/0140500 A1 May 2, 2024

(30) Foreign Application Priority Data

Mar. 26, 2021 (CN) ..... 202110328578.X

(51) Int. Cl.
*B61F 5/24* (2006.01)

(52) U.S. Cl.
CPC ..... *B61F 5/24* (2013.01)

(58) Field of Classification Search
CPC ..... Y02T 30/34; B61G 5/02; B61F 5/24
See application file for complete search history.

(56) References Cited

U.S. PATENT DOCUMENTS

2019/0126950 A1* 5/2019 Ogawa ..... F16F 15/023
2024/0140500 A1* 5/2024 Yang ..... B61G 5/02

FOREIGN PATENT DOCUMENTS

CN 201272365 Y 7/2009
CN 205168529 U 4/2016
(Continued)

OTHER PUBLICATIONS

JP_3428261_B2_Espacenet_machine_translation (Year: 2025).*
(Continued)

*Primary Examiner* — S. Joseph Morano
*Assistant Examiner* — Maxwell L Meshaka
(74) *Attorney, Agent, or Firm* — Womble Bond Dickinson (US) LLP

(57) ABSTRACT

The present application provides an anti-side-rolling damping vehicle-end device and a rail vehicle. The anti-side-rolling damping vehicle-end device comprises: a pair of damping mechanisms, which are adapted to respectively being installed on a pair of end walls of a pair of connected vehicle bodies that are arranged opposite each other, the pair of damping mechanisms being arranged on two sides of the axis of the vehicle bodies in a lengthwise direction, respectively; and a connecting rod, wherein two ends of the connecting rod are hinged to the pair of damping mechanisms, respectively, and the length of the connecting rod is greater than a vertical movement displacement of any vehicle body, such that side-rolling movement and vertical movement of the vehicle body is decoupled. By means of the anti-side-rolling damping vehicle-end device, it can be ensured that the length of the connecting rod connected between a pair of vehicle bodies can be far greater than a
(Continued)

vertical movement displacement of each vehicle body, such that the movement of the damping mechanisms can be limited by means of the connecting rod in different movement processes of the vehicle body, thereby at least achieving the decoupling between side-rolling movement and vertical movement of the vehicle body. Therefore, side-rolling vibration can be suppressed more reliably while vertical stability is not affected, and the running stability and the riding comfort of a rail vehicle are greatly improved.

10 Claims, 3 Drawing Sheets

(56) References Cited

FOREIGN PATENT DOCUMENTS

| | | | | | |
|---|---|---|---|---|---|
| CN | 205971343 | U | | 2/2017 | |
| CN | 107539333 | A | | 1/2018 | |
| CN | 107826141 | A | | 3/2018 | |
| CN | 109334702 | A | | 2/2019 | |
| CN | 109969211 | A | | 7/2019 | |
| CN | 211166896 | U | | 8/2020 | |
| CN | 112045608 | A | | 12/2020 | |
| CN | 113002581 | A | | 6/2021 | |
| DE | 2422825 | A1 | | 1/1975 | |
| EP | 1369331 | A1 | * | 12/2003 | ..... B61G 9/00 |
| JP | S5937168 | U | * | 3/1984 | |
| JP | S5940976 | A | * | 3/1984 | |
| JP | H0580951 | U | * | 11/1993 | |
| JP | H08169334 | A | * | 7/1996 | |
| JP | 09109888 | A | | 4/1997 | |
| JP | 3237425 | B2 | * | 12/2001 | |
| JP | 3428261 | B2 | * | 7/2003 | |
| JP | 2005289297 | A | | 10/2005 | |
| JP | 2006044425 | A | | 2/2006 | |
| JP | 2008201145 | A | | 9/2008 | |
| JP | 5209220 | B2 | * | 6/2013 | |
| KR | 20230090905 | A | * | 6/2023 | ..... B61G 7/00 |
| RU | 2406630 | C2 | | 12/2010 | |
| WO | 2018016035 | A1 | | 1/2018 | |
| WO | WO-2020244871 | A1 | * | 12/2020 | ..... B61F 5/24 |

OTHER PUBLICATIONS

Extended European Search Report received in related European Application No. 22773873.9, mailed Jul. 1, 2024, 7 pages.

Office Action received in related Russian application No. 2023126588, mailed Apr. 5, 2024, 18 pages.

* cited by examiner

ANTI-SIDE-ROLLING DAMPING VEHICLE-END DEVICE, AND RAIL VEHICLE AND TRAIN

CROSS-REFERENCE TO RELATED APPLICATION

The present application is a U.S. national stage application of international patent application No. PCT/CN2022/070345 filed on Jan. 5, 2022, entitled "ANTI-SIDE-ROLLING DAMPING VEHICLE-END DEVICE, AND RAIL VEHICLE AND TRAIN", which claims priority to Chinese application No. 202110328578.X filed on Mar. 26, 2021, entitled "Anti-side-rolling Damping Vehicle-end Device, and Rail Vehicle and Train", both of which are hereby incorporated by reference in their entirety.

FIELD

The present application relates to the technical field of rail vehicles, and in particular to an anti-roll car-end damping device and a rail vehicle, and a train.

BACKGROUND

With increases in the speed of a traditional electric multiple unit (EMU) and the number of decker of a car body, a car body has characteristics of large weight and high center of gravity, which in turn has higher and higher requirements for anti-rolling capabilities of rail vehicles. The anti-rolling of rail vehicles refers to the ability of the vehicle bodies to resist roll vibration. A double-decker EMU is taken as an example. Vehicle bodies of the double-decker EMU is significantly higher than vehicle bodies of a traditional train, which also has disadvantages such as a low damping ratio of the roll vibration of the vehicle bodies, a decrease in the roll stability and an increase in the roll angular velocity.

A traditional anti-roll device is usually mounted in a secondary suspension system between a bogie and a car body, can generate a damping force between the bogie and the car body, to suppress the roll motion. In order to provide a reliable anti-roll effect, in a traditional rail vehicle, both a secondary vertical damper usually provided in the suspension system and an increased damping of the secondary air spring can suppress the roll vibration, but it would adversely affect a vertical riding stability. In particular, the secondary vertical damper provides a vertical damping in addition to an anti-roll damping. For a vehicle with a high center of gravity and a large roll moment of inertia, in order to provide an appropriate anti-roll effect, it is necessary to set a larger damping of the secondary vertical damper, which adversely affects the vertical vibration transmission of the vehicle system and causes a deterioration of vertical stability.

SUMMARY

The present application provides an anti-roll car-end damping device, which solves the defect that an anti-roll device used in the related art adversely affects a vertical riding stability, and at least suppressing roll vibration without affecting the vertical stability.

The present application further provides a rail vehicle.

The present application further provides a train.

The present application provides an anti-roll car-end damping device, including:

a pair of damping mechanisms, where the pair of damping mechanisms are mounted on a pair of end walls disposed opposite to each other on a pair of connected vehicle bodies respectively, and provided on two sides of an axis of the vehicle bodies along a length direction respectively; and a connecting rod, where two ends of the connecting rod are hinged to the pair of damping mechanisms respectively, and the connecting rod has a length greater than a vertical motion displacement of any one of the vehicle bodies, to decouple a roll motion from a vertical motion between the vehicle bodies.

According to the anti-roll car-end damping device of the present application, each of the pair of the damping mechanisms includes:

a damper, where the damper is provided on each of the pair of the end walls, and a fixed end of the damper is hinged to the end wall; and a swing link, where the swing link is provided with a swinging fulcrum, a first end of the swing link is hinged to an end of the connecting rod, a second end of the swing link is hinged to a telescopic end of the damper, and the first end and the second end of the swing link is swingable relative to the swinging fulcrum.

According to the anti-roll car-end damping device of the present application, where when the vehicle bodies perform a roll motion, the swing link swings due to a restriction of the connecting rod to drive the damper to perform a telescopic motion, so as to generate a damping force; or when the vehicle bodies perform a vertical motion, the connecting rod moves along a vertical direction of the vehicle bodies, and no damping force is generated by the damper.

According to the anti-roll car-end damping device of the present application, the swing link includes a first link body and a second link body, where the first link body and the second link body form an L-shaped connection, the swinging fulcrum of the swing link is provided at the connection of the first link body and the second link body, a first end of the swing link is provided at an end of the first link body away from the swinging fulcrum, and a second end of the swing link is provided at an end of the second link body away from the swinging fulcrum, where an anti-roll damping coefficient of the anti-roll car-end damping device is inversely proportional to a length proportional coefficient of the swing link, and the length proportional coefficient of the swing link is a proportional coefficient between a length of the first link body and a length of the second link body.

According to the anti-roll car-end damping device of the present application, a swing speed of the first end of the swing link is a relative roll speed between the pair of vehicle bodies, and a swing speed of the second end of the swing link is a motion speed of the telescopic end of the damper;

when the swing speed of the second end of the swing link satisfies:

$$v_B = \frac{l_B}{l_A} v_A;$$

and a damping force generated by the damper on the second end of the swing link satisfies:

$$F_B = c v_B,$$

a force generated by the first end of the swing link satisfies:

$$F_A = \frac{l_B}{l_A} F_B = \left(\frac{l_B}{l_A}\right)^2 v_A c;$$

and an equivalent damping coefficient of the first end of the swing link satisfies:

$$c_A = \frac{F_A}{V_A} = \left(\frac{l_B}{l_A}\right)^2 c,$$

where:

$v_A$ represents the swing speed of the first end of the swing link;

$v_B$ represents the swing speed of the second end of the swing link;

$l_A$ represents the length of the first link body;

$l_B$ represents the length of the second link body;

$F_A$ represents the force generated by the first end of the swing link;

$F_B$ Represents the Damping Force Generated by the Damper on the Second End of the Swing Link;

c represents a damping coefficient of the damper;

$$\left(\frac{l_A}{l_B}\right)$$

represents a length proportional coefficient of the swing link; and $c_A$ represents the equivalent damping coefficient of the first end of the swing link, that is, the anti-roll damping coefficient of the anti-roll car-end damping device.

According to the anti-roll car-end damping device of the present application, the damping mechanism further includes:

a first mounting base, fixed to the end wall and hinged to the swinging fulcrum of the swing link; and a second mounting base, fixed to the end wall and hinged to the fixed end of the damper.

According to the anti-roll car-end damping device of the present application, the first mounting base and the swinging fulcrum of the swing link are connected through a sliding bearing, the second end of the swing link and a protruding end of the damper are connected through a sliding bearing, and the second mounting base and the fixed end of the damper are connected through a sliding bearing.

According to the anti-roll car-end damping device of the present application, the device further includes reset mechanisms, where the each reset mechanism is connected between the damping mechanism and an end wall corresponding to the damping mechanism.

According to the anti-roll car-end damping device of the present application, the reset mechanism includes a reset elastic piece and a reset mounting base, where a first end of the reset elastic piece is connected to the swing link, a second end of the reset elastic piece is connected to the reset mounting base, and the reset mounting base is fixed to the end wall.

According to the anti-roll car-end damping device of the present application, the first end of the reset elastic piece is connected between the swinging fulcrum of the swing link and the first end of the swing link.

According to the anti-roll car-end damping device of the present application, two ends of the connecting rod are hinged to the pair of damping mechanisms through fourth and fifth ball bearings respectively.

The present application further provides a rail vehicle including a plurality of vehicle bodies, where the above-mentioned anti-roll car-end damping device is mounted between a pair of adjacent vehicle bodies.

The present application provides an anti-roll car-end damping device, including: a pair of damping mechanisms, where the pair of damping mechanisms are mounted on a pair of end walls disposed opposite to each other on a pair of connected vehicle bodies respectively, and provided on two sides of an axis of the vehicle bodies along a length direction respectively; and a connecting rod, where each end of the connecting rod is hinged to the pair of damping mechanisms, and the connecting rod has a length greater than a vertical motion displacement of any one of the vehicle bodies, to decouple a roll motion from a vertical motion between the vehicle bodies. In the anti-roll car-end damping device, the pair of damping mechanisms provided symmetrically in the center are connected through a connecting rod, to ensure that the length of the connecting rod connected between a pair of vehicle bodies can be much larger than a displacement of the vertical motion between the vehicle bodies. The connecting rod can be used to limit the motion of the damping mechanism during different motions of the vehicle bodies, to at least decouple the roll motion from the vertical motion between the vehicle bodies, so as to suppress the roll vibration more reliably and smoothly without affecting the vertical stability, which greatly improves the smoothness during the operation of the rail vehicle and the riding comfort.

Further, in the anti-roll car-end damping device, on one hand, when the vehicle bodies perform a roll motion, the damping mechanism is used to generate a damping force under the limiting of the connecting rod, so as to efficiently and reliably suppress the roll motion of the vehicle bodies; on the other hand, when the vehicle bodies perform a vertical motion (i.e., a floating and sinking motion), the overall vertical motion of the connecting rod is used to limit the relative displacement of the vertical motion of a pair of vehicle bodies, so that no damping force is generated by the pair of damping mechanisms, thereby reliably decoupling the roll motion from the vertical motion between the vehicle bodies.

It can be seen that, compared with the related art, the anti-roll car-end damping device of the present application is mounted between oppositely provided end walls of adjacent vehicle bodies, which can generate a damping between adjacent vehicle bodies without affecting the bogie. Furthermore, the roll motion can be decoupled from the vertical motion between the vehicle bodies by the above-mentioned structure, i.e., when the vehicle bodies perform the roll motion, only an anti-roll damping is generated without providing vertical damping, so as to effectively avoid that a traditional suspension system generates large vertical damping in order to provide an appropriate anti-roll effect, which adversely affects a vertical vibration transmission. It can be seen that the anti-roll car-end damping device of the present application can avoid the bogie and directly provide an anti-roll damping between the vehicle bodies, thereby effectively improving the vertical operating stability of the vehicle.

The present application further provides a rail vehicle including a plurality of vehicle bodies, where the above-mentioned anti-roll car-end damping device is mounted between adjacent pairs of vehicle bodies. By providing the above-mentioned anti-roll car-end damping device, the rail vehicle has all advantages of the above-mentioned anti-roll car-end damping device, which would not be repeated herein.

The present application further provides a train including a plurality of rail vehicles. The above-mentioned anti-roll car-end damping device is mounted between at least one pair of adjacent rail vehicles. By providing the above-mentioned anti-roll car-end damping device, the train has all advantages of the above-mentioned anti-roll car-end damping device, which would not be repeated herein.

BRIEF DESCRIPTION OF THE DRAWINGS

In order to illustrate solutions of embodiments according to the present application or the related art more clearly, the accompanying drawings used in the description of the embodiments or the related art are briefly introduced below. It should be noted that the drawings in the following description are only some embodiments of the present application. For those of ordinary skill in the art, other drawings can be obtained according to these drawings.

Figure 1:
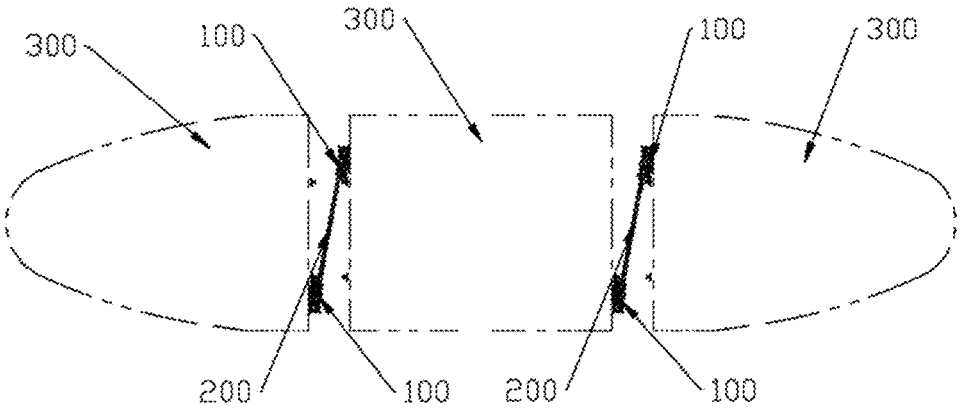
FIG. 1 is a schematic structural diagram of an anti-roll car-end damping device according to the present application assembled on a rail vehicle.

Reference numerals:

| | | |
|---|---|---|
| 100: damping mechanism; | 101: damper; | 102: swing link; |
| 1021: first link body; | 1022: second link body; | 1023: swinging fulcrum; |
| 103: first mounting base; | 104: second mounting base; | 105: reset elastic piece; |
| 106: reset mounting base; | 107: ball bearing; | 108: first sliding bearing; |
| 109: second sliding bearing; | 110: third sliding bearing; | 200: connecting rod; |
| 300: car body; | 301: first end wall; | 302: second end wall. |
| A: first end of the swing link; | B: second end of the swing link. | |

DETAILED DESCRIPTION

In order to illustrate purposes, solutions and advantages of the present application more clearly, solutions according to the present application are clearly described below in combination with the accompanying drawings in the present application. It should be noted that the described embodiments are some embodiments of the present application, rather than all the embodiments. Based on the embodiments of the present application, all other embodiments obtained by those of ordinary skill in the art are within the scope of protection of the present application.

Embodiments of the present application take double-decker EMU vehicles as an example to provide a specific description of the anti-roll car-end damping device of the present application. Due to the increased weight, increased inertia, increased center of gravity, and increased windward area of double-decker EMU vehicles having a speed of 350 km/h, the anti-roll car-end damping device is provided at an end of the vehicle bodies in order to ensure that the vehicles have a strong anti-roll capability, and can effectively attenuate a roll vibration of vehicle bodies, reduce a lateral vibration acceleration of the vehicle bodies, and improve the vehicle dynamics under a random wind load.

The anti-roll car-end damping device (which may be referred to as the "damping device" in embodiments of the present application) of the present application is described below in conjunction with FIG. 1 to FIG. 6.

As shown in FIG. 1, the damping device of the embodiments of the present application is connected between a pair of adjacent vehicle bodies 300, and can decouple a relative roll motion and a relative vertical motion (i.e., a floating and sinking motion) between the adjacent front and rear vehicle bodies 300, thereby suppressing the roll vibration without affecting the vertical stability, which greatly improves the smoothness during the operation of the rail vehicle and the riding comfort.

Figure 2:
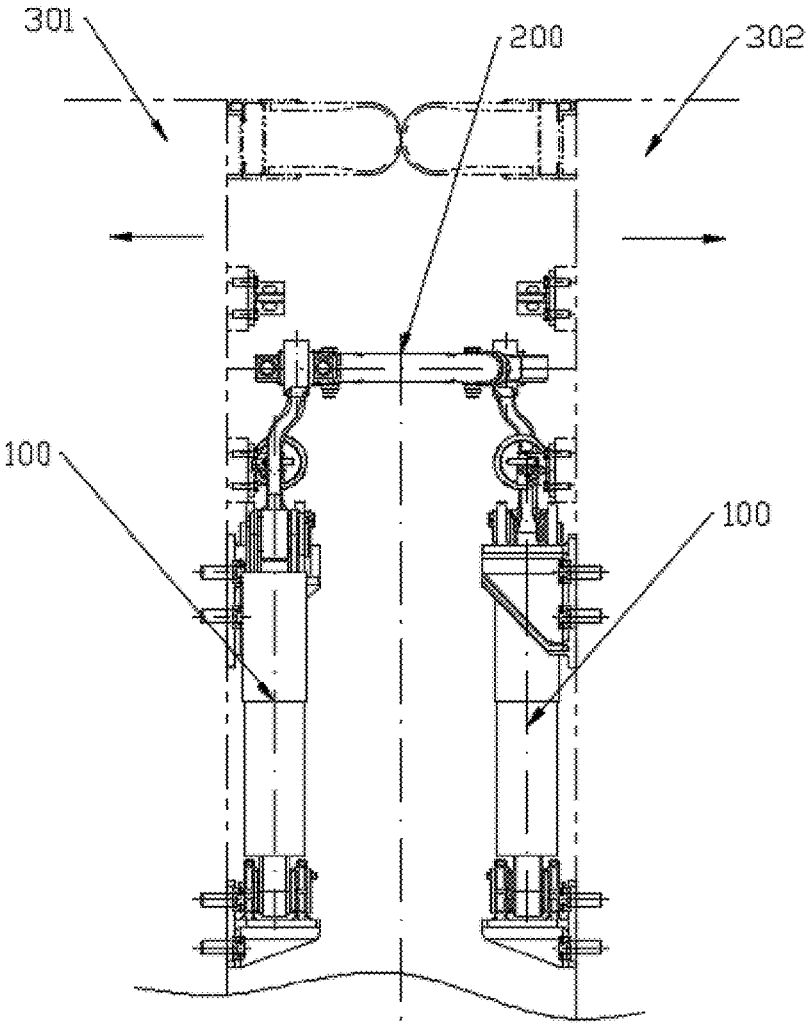
FIG. 2 is a schematic structural diagram of an anti-roll car-end damping device according to the present application assembled between adjacent vehicle bodies.
Figure 3:
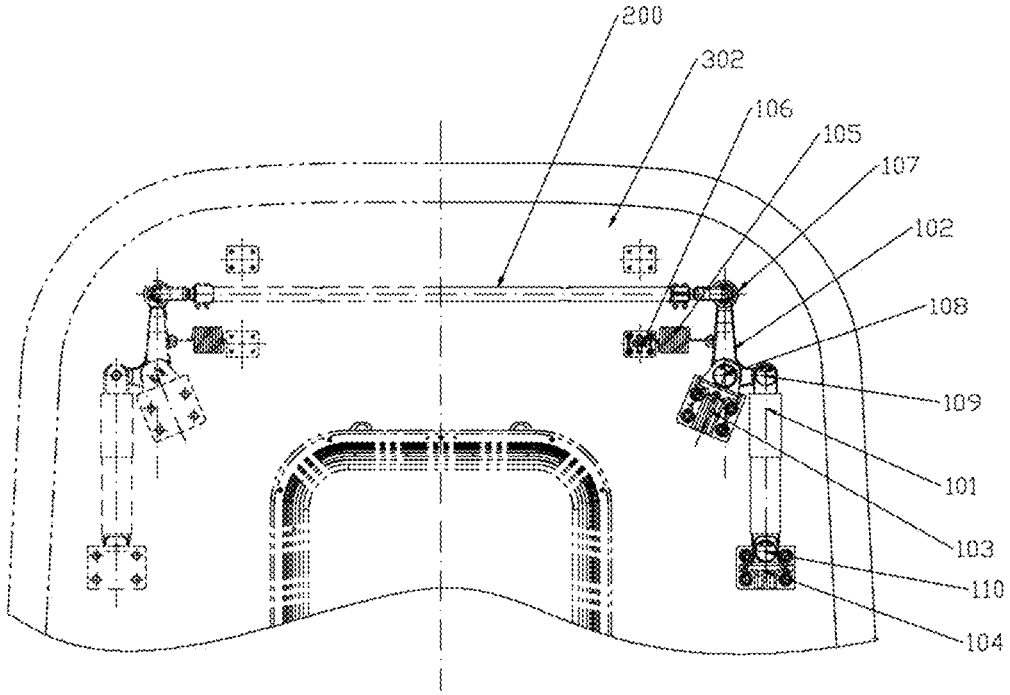
FIG. 3 is a schematic structural diagram of an anti-roll car-end damping device according to the present application.

As shown in FIG. 1, FIG. 2 and FIG. 3, the damping device includes a connecting rod 200 and a pair of damping mechanisms 100.

The pair of damping mechanisms 100 are mounted on a pair of connected vehicle bodies, respectively and on a pair of end walls provided in opposite directions, respectively. Moreover, the pair of damping mechanisms 100 are provided on two sides of an axis of the vehicle bodies along a length direction respectively, i.e., the pair of damping mechanisms 100 are provided centrosymmetrically with respect to a centerline of an inter-vehicle area between the pair of end walls as a symmetry axis, and the pair of damping mechanisms 100 are symmetrically provided relative to the symmetry axis. The centerline of the inter-vehicle area is provided as a center of the inter-vehicle area along a length direction of the vehicle bodies and a center along a width direction of the vehicle bodies.

Two ends of the connecting rod 200 are hinged to the pair of damping mechanisms 100 respectively. A length of the connecting rod 200 has a length greater than a vertical motion displacement of any one of the vehicle bodies, to decouple a roll motion from a vertical motion between the vehicle bodies. Since a length of the inter-vehicle area of the front and rear vehicle bodies is much larger than a displacement of the vertical motion of the vehicle bodies, and two ends of the connecting rod 200 are connected to two sides of the pair of vehicle bodies, the damping device can ensure that the length of the connecting rod 200 connected between a pair of vehicle bodies can be much larger than the displacement of the vertical motion of the vehicle bodies. The connecting rod 200 can be used to limit the motion of the damping mechanism during different motions of the vehicle bodies, to at least decouple the roll motion from the vertical motion between the vehicle bodies, so as to suppress the roll vibration of the vehicle bodies more reliably and smoothly without affecting the vertical stability of the vehicle bodies.

Supported by a bogie suspension system, the vehicle bodies would perform a variety of rigid body motions including a vertical motion and a roll motion during operation. In the related art, the roll motion of the vehicle bodies is usually attenuated through a vertical damping of a secondary suspension system, specifically by providing a secondary vertical damper or increasing a damping coefficient of an air spring. However, this would increase a secondary vertical damping in addition to a damping torque of the anti-rolling of the vehicle bodies, which leads to a decrease in riding comfort of the vehicle.

The damping device of the embodiments of the present application has at least the following differences compared to a traditional anti-roll damping device.

First, the traditional anti-roll damping device is usually mounted between a bogie and the vehicle bodies, and the roll motion of the vehicle bodies is suppressed by the bogie, and when the roll motion of the car body is suppressed, the force situation of the bogie would be adversely affected. The damping device of the present application is mounted between adjacent vehicle bodies, and relative motions between adjacent vehicle bodies drive the damping device to move, thereby suppressing the vehicle from performing roll motion.

Secondly, the traditional anti-roll damping device can only provide anti-roll stiffness, instead of anti-roll damping, and thus can only alleviate a roll impact, cannot attenuate the roll vibration; moreover, in order to attenuate the roll vibration of the vehicle bodies, it is usually necessary to additionally provide the above-mentioned secondary vertical damper on the basis of the traditional anti-roll damping device. However, the damping device of the present application can provide an anti-roll damping by itself, thereby effectively attenuating the energy of the roll motion. Since the damping device of the present application decouples the roll motion from the vertical motion between the vehicle bodies, it solves an unfavorable effect on the vertical stability of the vehicle bodies caused by a too large damping force of the secondary vertical damper, that is, it can only increase the anti-roll damping without increasing the original vertical damping.

Further, in the damping device of the embodiment of the present application, on one hand, when the vehicle bodies perform a roll motion, under the limiting of the connecting rod 200, the damping mechanism 100 is used to generate a damping force, so as to efficiently and reliably suppress the roll motion of the vehicle bodies; on the other hand, when the vehicle bodies perform a vertical motion (i.e., a floating and sinking motion), the overall vertical motion of the connecting rod 200 is used to limit the relative displacement of the vertical motion between a pair of vehicle bodies, so that no damping force is generated by the pair of damping mechanisms 100, thereby reliably decoupling the roll motion from the vertical motion between the vehicle bodies.

It can be seen that, compared with the related art, the damping device of the embodiment of the present application is mounted between oppositely provided end walls of adjacent vehicle bodies, which can generate a damping between adjacent vehicle bodies without affecting the bogie. Furthermore, the roll motion can be decoupled from the vertical motion between the vehicle bodies by the above-mentioned structure, i.e., when the vehicle bodies perform the roll motion, only an anti-roll damping is generated without providing vertical damping, so as to effectively avoid that a traditional suspension system generates large vertical damping in order to provide an appropriate anti-roll effect, which adversely affects a vertical vibration transmission. It can be seen that the anti-roll car-end damping device of embodiment of the present application can avoid the bogie and directly provide an anti-roll damping between the vehicle bodies, thereby effectively improving the vertical operating stability of the vehicle.

Taking FIG. 1 and FIG. 3 as an example, one of the pair of damping mechanisms 100 is mounted on a left side of a first end wall 301, and the other of the pair of damping mechanisms 100 is mounted on a right side of a second end wall 302, so as to enable the pair of damping mechanisms 100 to be symmetrically provided relative to the above-mentioned symmetry axis. The first end wall 301 and the second end wall 302 are a pair of end walls of two vehicle bodies connected front to back and opposite to each other, respectively. That is, the first end wall 301 is the end wall of the front car body and the second end wall 302 is the end wall of the rear car body.

It is to be noted that the arrangement of the above-mentioned pair of damping mechanisms 100 can be switched from left to right. That is, one of the pair of damping mechanisms 100 is mounted on a right side of the first end wall 301, and then the other of the pair of damping mechanisms 100 is mounted on a left side of the second end wall 302. It is only necessary to provide the pair of damping mechanisms 100 to be centrosymmetric with respect to the above-mentioned symmetry axis.

In order to further improve the operating stability and riding comfort of the entire set of rail vehicles, it is preferred that damping devices between each pair of adjacent vehicle bodies in the same rail vehicle is provided as the following: all of the damping mechanisms 100 mounted on the first end wall 301 are mounted on a same side of the first end wall 301, and all of the damping mechanisms 100 mounted on the second end wall 302 are mounted on another side of the second end wall 302. That is, it is ensured that in the same rail vehicle, connecting rods 200 in each inter-vehicle area are provided in a same direction.

In order to ensure that the pair of damping mechanisms 100 can be provided symmetrically in the center, it is preferred that the damping mechanism 100 on the first end wall 301 are provided opposite to the damping mechanism 100 on the second end wall 302.

In some embodiments, as shown in FIG. 3, the damping mechanism 100 includes a damper 101 and a swing link 102. The damper 101 is provided on a corresponding end wall, and a fixed end of the damper 101 is hinged to this end wall. Preferably, the damper 101 is provided on the end wall along a vertical direction. The damper 101 is used to generate an attenuation damping force to attenuate the vibration of the vehicle bodies. The swing link 102 is used to convert a lateral motion (i.e., the roll motion) between the vehicle bodies into a vertical telescopic motion of the damper 101, and adjust the anti-roll damping coefficient between the vehicle bodies.

Understandably, the swing link 102 is provided with a swinging fulcrum 1023. A first end of the swing link is hinged to an end of the connecting rod 200. A second end of the swing link is hinged to the telescopic end of the damper 101. Moreover, the first end and the second end of the swing link is swingable relative to the swinging fulcrum 1023. On one hand, the swing link 102 drives the damper 101 to perform a telescopic motion during the swinging process, and on the other hand, it can be limited and driven by the connecting rod 200, thereby reliably decouple the roll motion from the vertical motion between the vehicle bodies.

Figure 6:
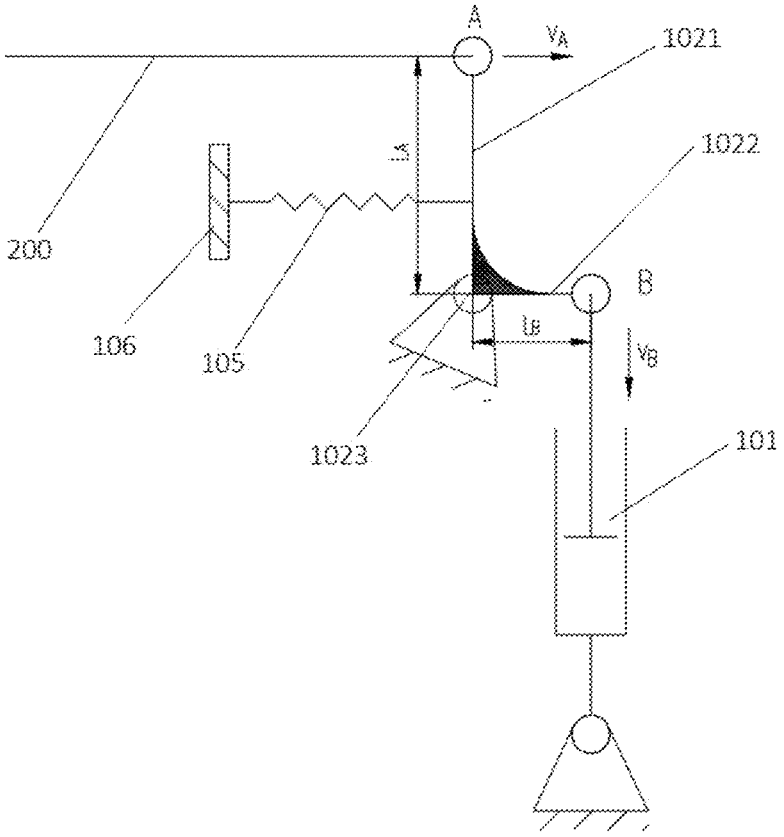
FIG. 6 is a simplified schematic diagram of a working principle of a damping mechanism according to the present application.

In some embodiments, as shown in FIG. 3 and FIG. 6, the swing link 102 includes a first link body 1021 and a second link body 1022. The first link body 1021 and the second link body 1022 form an L-shaped connection. The swinging fulcrum 1023 of the swing link 102 is provided at the connection of the first link body 1021 and the second link body 1022. A first end of the swing link is provided at an end of the first link body 1021 away from the swinging fulcrum 1023. A second end of the swing link is provided at an end of the second link body 1022 away from the swinging fulcrum 1023. The swing link 102 having an L-shaped structure can transmit a damping effect of the damper 101 to the connecting rod 200 during the swinging process, and transmit a limiting and driving effect of the connecting rod 200 to the damper 101. Furthermore, the swing link 102 having an L-shaped structure can also adjust the anti-roll damping coefficient of the damping device by adjusting a length proportional relationship between the first link body 1021 and the second link body 1022. By adjusting a damping coefficient of the damper 101 and structural parameters of the swing link 102, the anti-roll damping can be adjusted without affecting the vertical damping. For the anti-vibration system of the entire rail vehicle, the roll stability can be greatly improved without affecting the vertical stability. Moreover, by flexibly adjusting the length proportional relationship between the first link body 1021 and the second link body 1022 of the swing link 102, different vehicles can be adapted based on a same type of the damper 101, the speed of the telescopic motion of the damper 101 is reduced, and the operating reliability of the damper 101 is enhanced.

In some embodiments, when the vehicle bodies perform a roll motion, the swing link 102 swings due to being restricted by the connecting rod 200 and, and drives the damper 101 to perform a telescopic motion to generate a damping force. when the vehicle bodies perform a vertical motion, the connecting rod 200 moves along the vertical direction of the vehicle bodies and no damping force is generated by the damper 101.

Figure 4:
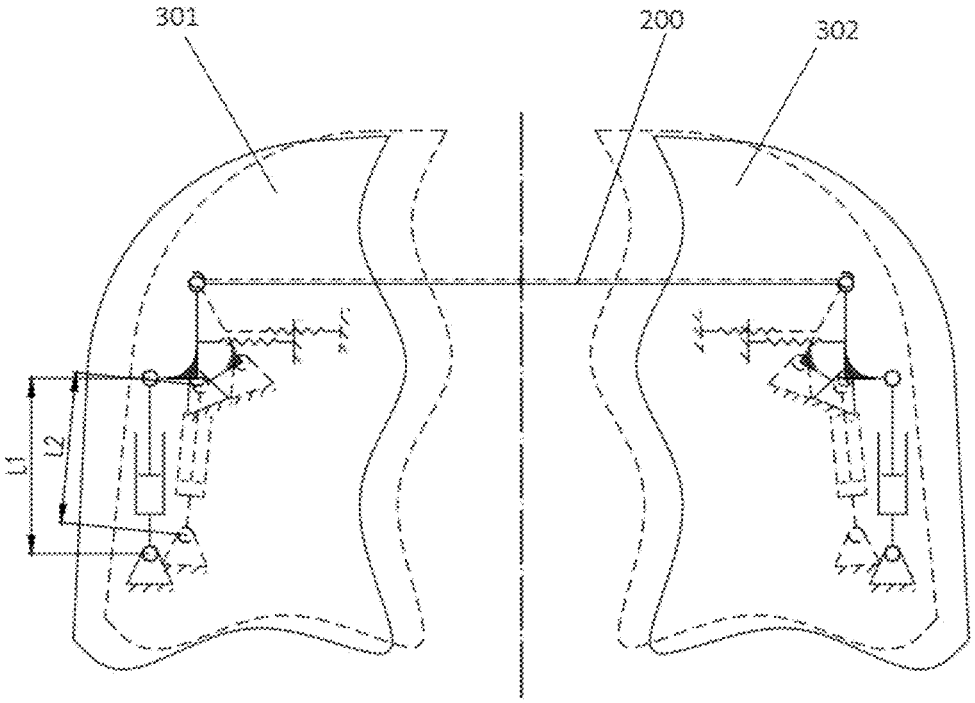
FIG. 4 is a schematic diagram showing an operating state of an anti-roll car-end damping device according to the present application when vehicle bodies perform a roll motion.
Figure 5:
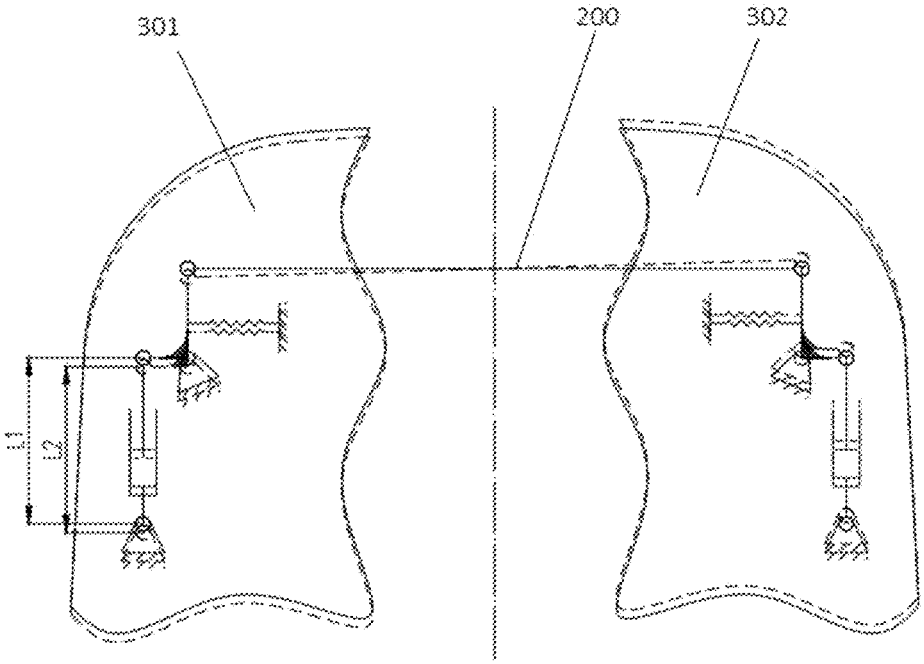
FIG. 5 is a schematic diagram showing an operating state of an anti-roll car-end damping device according to the present application when vehicle bodies perform a vertical motion.

Specifically, FIG. 4 illustrates an operating state of the damping device when the vehicle bodies perform a roll motion. In FIG. 4, a solid line shows an initial state of the vehicle bodies before performing the roll motion, and a dashed line shows an operating state of the vehicle bodies after performing the roll motion. FIG. 5 illustrates an operating state of the damping device when vehicle bodies perform a vertical motion. In FIG. 5, a solid line shows an initial state of the vehicle bodies before performing the vertical motion, and a dashed line shows an operating state of the vehicle bodies after performing the vertical motion. L1 represents a total length of the damper 101 in the initial state and L2 represents a total length of the damper 101 in the operating state.

As can be seen from FIG. 4, the first end of the L-shaped swing link is restricted by the horizontally disposed connecting rod 200 due to the transverse movement of the vehicle bodies to cause a large angle of oscillation between the first end and the second end of the swing link and drive the damper 101 to perform tensile and compressive motions, to cause the damper 101 to generate a damping force. That is, the damping device has an anti-lateral-roll damping coefficient, and thus suppresses a relative roll motion of the vehicle bodies.

As can be seen from FIG. 5, since the length of the connecting rod 200 provided horizontally is much greater than a relative vertical motion displacement of the vehicle bodies, only the connecting rod 200 swings at a small angle. The connecting rod 200 limits the swing link 102 connected at two ends, so that the swing link 102 of the damping mechanism 100 hardly swings, and the damper 101 hardly performs the tensile and compressive motions, so that no damping force is generated by the damper 101.

Preferably, the connecting rod 200 is provided to be equal to or greater than 2000 mm. Since the vertical motion displacement of the vehicle bodies of a traditional rail vehicle is about 30 mm, it can be obtained that the length of the connecting rod 200 is much larger than the relative vertical motion displacement of the vehicle bodies.

As shown in FIG. 4 and FIG. 5, the damping device of the embodiment of the present application decouple the roll motion from the vertical motion between the vehicle bodies. Only by adjusting the damping coefficient of the damper 101, and adjusting the length proportional coefficient between the first link body 1021 and the second link body 1022 of the swing link 102, the damping device can adjust the anti-roll damping without affecting the vertical damping. For the entire vehicle damping system, the roll stability is improved without affecting the vertical stability of the vehicle bodies.

In some embodiments, in order to flexibly adjust the anti-roll damping coefficient of the damping device, it is preferred to determine that the anti-roll damping coefficient of the damping device is inversely proportional to a length proportional coefficient of the swing link 102. The length proportional coefficient of the swing link 102 is a proportional coefficient between a length of the first link body 1021 and a length of the second link body 1022.

Specifically, as shown in FIG. 6, a swing speed of the first end A of the swing link 102 is relative roll speed between the pair of vehicle bodies. A swing speed of the second end B of the swing link 102 is a motion speed of the telescopic end of the damper 101;

when the swing speed of the second end B of the swing link 102 satisfies:

$$v_B = \frac{l_B}{l_A} v_A;$$

and a damping force generated by the damper 101 on the second end B of the swing link 102 satisfies:

$$F_B = cv_B,$$

a force generated by the first end A of the swing link 102 satisfies:

$$F_A = \frac{l_B}{l_A} F_B = \left(\frac{l_B}{l_A}\right)^2 v_A c;$$

and an equivalent damping coefficient of the first end A of the swing link 102 satisfies:

$$c_A = \frac{F_A}{V_A} = \left(\frac{l_B}{l_A}\right)^2 c,$$

where:

$v_A$ represents the swing speed of the first end A of the swing link 102;

$v_B$ represents the swing speed of the second end B of the swing link 102;

$l_A$ represents the length of the first link body 1021;

$l_B$ represents the length of the second link body 1022;

$F_A$ represents the force generated by the first end A of the swing link 102;

$F_B$ represents the damping force generated by the damper 101 on the second end B of the swing link 102;

c represents the damping coefficient of the damper 101;

$$\left(\frac{l_A}{l_B}\right)$$

represents a length proportional coefficient of the swing link 102; and $c_A$ represents the equivalent damping coefficient of the first end A of the swing link 102, that is, the anti-roll damping coefficient of the anti-roll car-end damping device.

It is understood that the swing speed of the first end A of the above-mentioned swing link 102 is associated with a relative roll angular velocity co between the pair of vehicle bodies and the height of the connecting rod 200 from an air spring support surface H of the vehicle bodies.

The swing link 102 of the damping mechanism 100 has at least the following advantages.

(1) In case of using the same type of damper 101, the equivalent damping coefficient of the damping mechanism can be flexibly changed by adjusting the length proportional coefficient of the swing link 102, and the damping mechanism can be adapted to different vehicle parameters.

(2) The L-shaped link body of the swing link 102 can effectively reduce the motion speed transmitted from the vehicle bodies to the damper 101, which is more conducive to the difficulty of the structural design of components in the damping device, simplifies the damping device, and greatly improves the service life of the components of the damping device.

In some embodiments, as shown in FIG. 3, the damping mechanism 100 further includes a first mounting base 103 and a second mounting base 104. The first mounting base 103 is fixed to an end wall and hinged between the swinging fulcrum 1023 of the swing link 102. The second mounting base 104 is fixed to the end wall and hinged to the fixed end of the damper 101. The first mounting base 103 and the second mounting base 104 are used to provide reliable fixed support for the swinging of the swing link 102 and the telescopic motion of the damper 101, respectively.

Understandably, in order to further improve the structural reliability of the above-mentioned hinged structure, it is preferred that the first mounting base 103 is connected to the swinging fulcrum 1023 of the swing link 102 by a first sliding bearing 108, the second end of the swing link is connected to a protruding end of the damper 101 by a second sliding bearing 109, and the second mounting base 104 is connected to the fixed end of the damper 101 by a third sliding bearing 110. The arrangement of the sliding bearings ensures that the motion planes of various components of the damping mechanism 100 are always kept parallel or coincident to a plane where the end wall is located.

Understandably, in order to further improve the structural reliability of the hinged structure between two ends of the connecting rod 200 and the pair of damping mechanisms 100, it is preferred that two ends of the connecting rod 200 are hinged to the pair of damping mechanisms 100 through ball bearings 107 respectively. The ball bearing 107 can ensure a multi-dimensional rotation between an end of the connecting rod 200 and the first end of the swing link 102.

In some embodiments, as shown in FIG. 3, the anti-roll car-end damping device further includes reset mechanisms. Each reset mechanism is connected between the damping mechanism 100 and an end wall corresponding to the damping mechanism. The reset mechanism is used to ensure that the damping mechanism 100 can be reset in a timely manner after the vehicle bodies perform an above-mentioned rigid motion, so as to ensure that the damping mechanism 100 can more reliably cope with a next sudden change in the motion of the vehicle bodies. Preferably, the reset mechanism includes a reset elastic piece 105 and a reset mounting base 106. A first end of the reset elastic piece 105 is connected to the swing link 102, and a second end of the reset elastic piece 105 is connected to the reset mounting base 106. The reset mounting base 106 is fixedly attached to the end wall. The first end of the reset elastic piece 105 is connected between the swinging fulcrum 1023 of the swing link 102 and the first end of the swing link 102, so as to reset the swing of the swing link 102 by using the reset mechanism.

Understandably, the reset elastic piece 105 is preferably a reset spring.

The rail vehicle of the embodiments of the present application includes a plurality of vehicle bodies. It should be noted that the vehicle bodies may be driver's compartment vehicle bodies or intermediate vehicle bodies. The above-mentioned anti-roll car-end damping device is mounted between adjacent pairs of vehicle bodies. It can be seen that the anti-roll car-end damping device of the present application can avoid the bogie and directly provide an anti-roll damping between the vehicle bodies, thereby effectively improving the vertical operating stability of the vehicle.

The train of the embodiment of the present application includes a plurality of rail vehicles. The above-mentioned anti-roll car-end damping device are mounted between at least one pair of adjacent rail vehicles. By providing the above-mentioned anti-roll car-end damping device, the train has all advantages of the above-mentioned anti-roll car-end damping device, which would not be repeated herein.

In the description of the present application, it is to be noted that, the orientation or positional relations specified by terms such as "central", "longitudinal", "transverse", "upper", "lower", "front", "back", "left", "right", "vertical", "horizontal", "top", "bottom", "inner", "outer" and the like, are based on the orientation or positional relations shown in the drawings, which is merely for convenience of description of the present application and to simplify description, but does not indicate or imply that the stated devices or members must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the stage height of the first feature is higher than that of the second feature. The first feature is "under", "below" and "beneath" the second feature can refer to that the first feature is directly below or obliquely below the second feature, or simply refer to that the stage height of the first feature is lower than that of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art may combine the different embodiments or examples described in this specification, as well as the features of the different embodiments or examples, without conflicting each other.

Finally, it should be noted that the above embodiments are only used to explain the solutions of the present application, and are not to limited them. Although the present application has been described in detail with reference to the foregoing embodiments, it should be understood by those skilled in the art that they can still modify the solutions documented in the foregoing embodiments and make equivalent substitutions to a part of the features; these modifications and substitutions do not make the essence of the corresponding solutions depart from the scope of the solutions of various embodiments of the present application.

What is claimed is:

1. An anti-roll car-end damping device, comprising:

a pair of damping mechanisms, wherein the pair of damping mechanisms are mounted on a pair of end walls disposed opposite to each other on a pair of connected vehicle bodies respectively, and provided symmetrically on two sides of an axis of the vehicle bodies along a length direction respectively; and a connecting rod, wherein two ends of the connecting rod are hinged to the pair of damping mechanisms respectively, and the connecting rod has a length greater than a vertical motion displacement of any one of the vehicle bodies, to decouple a roll motion from a vertical motion between the vehicle bodies;

wherein each of the pair of the damping mechanisms comprises:

a damper, wherein the damper is provided on each of the pair of the end walls, and a fixed end of the damper is hinged to the end wall; and a swing link, wherein the swing link is provided with a swinging fulcrum, a first end of the swing link is hinged to an end of the connecting rod, a second end of the swing link is hinged to a telescopic end of the damper, and the first end and the second end of the swing link is swingable relative to the swinging fulcrum;

when the vehicle bodies perform a roll motion, the swing link swings due to a restriction of the connecting rod to drive the damper to perform a telescopic motion to generate a damping force; and when the vehicle bodies perform a vertical motion, the connecting rod moves along a vertical direction of the vehicle bodies, and no damping force is generated by the damper;

wherein the swing link comprises a first link body and a second link body, wherein the first link body and the second link body form an L-shaped connection, the swinging fulcrum of the swing link is provided at the connection of the first link body and the second link body, a first end of the swing link is provided at an end of the first link body away from the swinging fulcrum, and a second end of the swing link is provided at an end of the second link body away from the swinging fulcrum, wherein an anti-roll damping coefficient of the anti-roll car-end damping device is inversely proportional to a length proportional coefficient of the swing link, and the length proportional coefficient of the swing link is a proportional coefficient between a length of the first link body and a length of the second link body;

anti-roll damping is adjusted without affecting the vertical damping by adjusting a damping coefficient of the damper and structural parameters of the swing link.

2. The device of claim 1, wherein a swing speed of the first end of the swing link is a relative roll speed between the pair of vehicle bodies, and a swing speed of the second end of the swing link is a motion speed of the telescopic end of the damper;

when the swing speed of the second end of the swing link satisfies:

$$v_B = \frac{l_B}{l_A} v_A;$$

and a damping force generated by the damper on the second end of the swing link satisfies:

$$F_B = c v_B,$$

a force generated by the first end of the swing link satisfies:

$$F_A = \frac{l_B}{l_A} F_B = \left(\frac{l_B}{l_A}\right)^2 v_A c;$$

and an equivalent damping coefficient of the first end of the swing link satisfies:

$$c_A = \frac{F_A}{V_A} = \left(\frac{l_B}{l_A}\right)^2 c,$$

where:

$v_A$ represents the swing speed of the first end of the swing link;

$v_B$ represents the swing speed of the second end of the swing link;

$l_A$ represents the length of the first link body;

$l_B$ represents the length of the second link body;

$F_A$ represents the force generated by the first end of the swing link;

$F_B$ represents the damping force generated by the damper on the second end of the swing link;

c represents a damping coefficient of the damper;

$$\left(\frac{l_A}{l_B}\right)$$

represents a length proportional coefficient of the swing link; and $c_A$ represents the equivalent damping coefficient of the first end of the swing link, that is, the anti-roll damping coefficient of the anti-roll car-end damping device.

3. The device of claim 1, wherein the damping mechanism further comprises:

a first mounting base, fixed to the end wall and hinged between the swinging fulcrum of the swing link; and a second mounting base, fixed to the end wall and hinged to the fixed end of the damper.

4. The device of claim 3, wherein the first mounting base and the swinging fulcrum of the swing link are connected through a sliding bearing, the second end of the swing link and a protruding end of the damper are connected through a sliding bearing, and the second mounting base and the fixed end of the damper are connected through a sliding bearing.

5. The device of claim 1, further comprising reset mechanisms, wherein each of the reset mechanisms is connected between the damping mechanism and an end wall corresponding to the damping mechanism.

6. The device of claim 5, wherein the reset mechanism comprises a reset elastic piece and a reset mounting base, wherein a first end of the reset elastic piece is connected to the swing link, a second end of the reset elastic piece is connected to the reset mounting base, and the reset mounting base is fixed to the end wall.

7. The device of claim 6, wherein the first end of the reset elastic piece is connected between the swinging fulcrum of the swing link and the first end of the swing link.

8. The device of claim 1, wherein two ends of the connecting rod are hinged to the pair of damping mechanisms through ball bearings respectively.

9. A rail vehicle, comprising a plurality of vehicle bodies, wherein the anti-roll car-end damping device of claim 1 is mounted between at least one adjacent pair of vehicle bodies.

10. A train, comprises a plurality of rail vehicles, wherein the anti-roll car-end damping device of claim 1 is mounted between at least one pair of adjacent rail vehicles.

* * * * *